US011050130B1

(12) United States Patent
Uemichi

(10) Patent No.: US 11,050,130 B1
(45) Date of Patent: Jun. 29, 2021

(54) DIELECTRIC WAVEGUIDE

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/757,818

(22) PCT Filed: Oct. 26, 2018

(86) PCT No.: PCT/JP2018/039847
§ 371 (c)(1),
(2) Date: Apr. 21, 2020

(87) PCT Pub. No.: WO2019/087955
PCT Pub. Date: May 9, 2019

(30) Foreign Application Priority Data

Nov. 1, 2017 (JP) ..... JP2017-211961

(51) Int. Cl.
*H01P 5/08* (2006.01)
*H01P 3/16* (2006.01)
*H01P 1/16* (2006.01)

(52) U.S. Cl.
CPC ..... *H01P 3/16* (2013.01); *H01P 1/16* (2013.01); *H01P 5/087* (2013.01)

(58) Field of Classification Search
CPC ..... H01P 5/08; H01P 5/00; H01P 5/02; H01P 5/082; H01P 5/087; H01P 5/107; H01P 5/103; H01P 1/08; H01P 1/2002; H01P 1/2088; H01P 1/264; H01P 3/16;
(Continued)

(56) References Cited

U.S. PATENT DOCUMENTS 8,884,716 B2 * 11/2014 Choi ..... H01P 5/107 333/26
10,170,815 B2 * 1/2019 Uemichi ..... H01P 3/08
2013/0120088 A1 5/2013 Wu et al.

FOREIGN PATENT DOCUMENTS

JP 2003-298322 A 10/2003
JP 2005-354694 A 12/2005
JP 2006-005818 A 1/2006
(Continued)

OTHER PUBLICATIONS

International Search Report dated Nov. 27, 2018, issued in counterpart Application No. PCT/JP2018/039847. (2 pages).
(Continued)

*Primary Examiner* — Stephen E. Jones
(74) *Attorney, Agent, or Firm* — Westerman, Hattori, Daniels & Adrian, LLP

(57) ABSTRACT

Provided is a dielectric waveguide having a good reflection characteristic also in a band on a low frequency side of a center frequency of a given operation band. A dielectric waveguide (1) includes: a waveguide region (12) which is defined by a first wide wall (21), a second wide wall (22), a first narrow wall (23), a second narrow wall (24), and a short wall (25) and which is filled with a dielectric; and a mode conversion section (31) which includes a columnar conductor (34) extending from a surface of the waveguide region (12) toward an inside of the waveguide region (12). A width ($W_2$) of the short wall (25) is configured to be greater than a waveguide width (Wi) at a location ($x=x_1$) at which the columnar conductor (34) is provided.

2 Claims, 6 Drawing Sheets

(58) Field of Classification Search
CPC .. H01P 3/122; H01P 3/165; H01P 3/00; H01P 3/121
USPC ..... 333/21 R, 208, 209, 239, 248, 254
See application file for complete search history.

(56) References Cited

FOREIGN PATENT DOCUMENTS

| | | | |
|---|---|---|---|
| JP | 2006-157198 | A | 6/2006 |
| JP | 2006-191428 | A | 7/2006 |
| JP | 2008-193162 | A | 8/2008 |
| JP | 2017-017638 | A | 1/2017 |

OTHER PUBLICATIONS

Notification of Transmittal of Translation of the International Preliminary Report on Patentability (Form PCT/IB/338) issued in counterpart International Application No. PCT/JP2018/039847 dated May 14, 2020 with Forms PCT/IB/373 and PCT/ISA/237. (9 pages).

Jemichi et al., "A study on the broadband transitions between micro strip line and post-wall waveguide in E-band", 2016 46th European Microwave Conference (EuMC), IEEE, Oct. 4, 2016, pp. 13-16; Cited in ISR, Specification and Written Opinion. (4 pages).

Jemichi et al., "Characterization of 60-GHz silica-based post-wall waveguide and low-loss substrate dielectric", 2016 Asia-Pacific Microwave Conference (APMC), IEEE, Dec. 5, 2016; Cited in ISR and Written Opinion. (4 pages).

Ito, Kazuhiro et al, "60-GHz Band Dielectric Waveguide Filters Made of Crystalline Quartz", Microwave Symposium Digest, 2005 IEEE MTT-S International, Jun. 2005; Cited in the Specification. (4 pages).

Uemichi et al, "A ultra low-loss silica-based transformer between microstrip line and post-wall waveguide for millimeter-wave antenna-in-package applications," IEEE MTT-S IMS, Jun. 2014, ; Cited in the Specification. (3 pages).

Yang, Cai et al., "Millimeter Wave Low-Profile Relay Antennas for 5G Full Duplex Self-Interference Suppression", IEEE International Conference on Signal processing, Communications and Computing, Oct. 22, 2017, pp. 1-4, Cited in EESR dated Oct. 28, 2020.

* cited by examiner $W_2 = W_1 = 1.32mm$
PWW101 : $D_{BS} = 584\mu m$
PWW101A: $D_{BS} = 634\mu m$
PWW101B: $D_{BS} = 684\mu m$

DIELECTRIC WAVEGUIDE

TECHNICAL FIELD

The present invention relates to a dielectric waveguide configured such that a waveguide region is filled with a dielectric.

BACKGROUND ART (Two Modes of Dielectric Waveguide)

In a first mode of a dielectric waveguide whose operation band is a millimeter wave band typified by the E band (approximately 70 GHz to 90 GHz) and which is configured such that a waveguide region is filled with a dielectric, the dielectric waveguide includes (i) a columnar member (or a long slender plate-shaped member) which is made of a dielectric and (ii) a conductor film which covers surfaces of the columnar member (see, for example, Non-Patent Literature 1). In a case where the columnar member has a rectangular cross section, side surfaces of the columnar member are respectively surrounded by a pair of wide walls and a pair of narrow walls, and an end surface of the columnar member is covered with a short wall. The pair of wide walls, the pair of narrow walls, and the short wall are constituted by the conductor film. In this specification, a dielectric waveguide of this type will be referred to as a conductor film surrounding dielectric waveguide.

In a second mode of the dielectric waveguide, the dielectric waveguide includes a substrate which is made of a dielectric, a pair of conductor films which respectively cover both surfaces of the substrate, and a post wall which is provided inside the substrate. The pair of conductor films are read as a pair of wide walls. The post wall includes a pair of post walls which face each other and a post wall via which an end part of one of the pair of post walls is connected to a corresponding end part of the other of the pair of post walls. The pair of post walls are read as a pair of narrow walls. The post wall, via which the end part of the one of the pair of post walls is connected to the corresponding end part of the other of the pair of post walls, is read as a short wall. The dielectric waveguide in the second mode is referred to as a post-wall waveguide. As compared with the conductor film surrounding dielectric waveguide, the post-wall waveguide allows an increase in degree of integration in a case where a transmission device and an electronic component are integrated. Examples of the transmission device include, in addition to waveguides, filters, directional couplers, and diplexers. Examples of the electronic component include resistors, capacitors, and radio frequency integrated circuits (RFICs).

According to a post-wall waveguide disclosed in each of Non-Patent Literatures 2 and 3, a blind via is provided in a vicinity of a short wall. A conductor film having a columnar shape is provided on an inner wall of the blind via. The blind via protrudes toward an inside of a waveguide region from a surface of the waveguide region on which surface one of wide walls is provided.

A dielectric layer is provided on a surface of the one of the wide walls of the post-wall waveguide, and a signal line is provided on a surface of the dielectric layer. The signal line is disposed so that one of end parts of the signal line is electrically continuous with an upper end part (an end part located on a surface side of the waveguide region) of the blind via. The signal line and the one of the wide walls constitute a microstrip line (MSL). The blind via allows a conversion between (i) a mode in which an electromagnetic wave propagates inside the MSL and (ii) a mode in which the electromagnetic wave propagates inside the waveguide region of the post-wall waveguide. A mode conversion section constituted by the blind via, the dielectric layer, and the signal line functions as an input-output port of the post-wall waveguide.

CITATION LIST

Non-Patent Literature

[Non-Patent Literature 1]

Kazuhiro Ito, Kazuhisa Sano, "60-GHz Band Dielectric Waveguide Filters Made of Crystalline Quartz", Microwave Symposium Digest, 2005 IEEE MTT-S International, June 2005

[Non-Patent Literature 2]

Yusuke Uemichi, et al. "A ultra low-loss silica-based transformer between microstrip line and post-wall waveguide for millimeter-wave antenna-in-package applications," IEEE MTT-S IMS, June 2014.

[Non-Patent Literature 3]

Yusuke Uemichi, et al. "A study on the broadband transitions between microstrip line and post-wall waveguide in E-band," in Eur. Microw. Conf., October 2016.

SUMMARY OF INVENTION

Technical Problem

In a case where a dielectric waveguide as described above is designed, a given operation band is first determined and then design parameters of a waveguide region and design parameters of a mode conversion section are optimized. The design parameters of the waveguide region and the design parameters of the mode conversion section are wide-ranging. However, a major one of the design parameters of the waveguide region is a width W which is a width of the waveguide region (a distance between a pair of narrow walls), and a major one of the design parameters of the mode conversion section is a distance $D_{BS}$ which is a distance between a blind via and a short wall.

For example, in a case where the given operation band is a band of not less than 71 GHz and not more than 86 GHz, the width W is determined depending on a guide wavelength which corresponds to a cut-off frequency $f_{co}$ obtained by dividing a center frequency $f_c$ (78.5 GHz in this case) of the operation band by 1.5. A value of the distance $D_{BS}$ is optimized depending on the center frequency $f_c$.

By the way, the E band is divided into a plurality of subbands. The plurality of subbands are often used for different purposes. For example, the band of not less than 71 GHz and not more than 86 GHz is divided into three subbands. A subband of not less than 71 GHz and not more than 76 GHz is referred to as a low band, and a subband of not less than 81 GHz and not more than 86 GHz is referred to as a high band. For example, a radio transmitter-receiver whose operation band is the band of not less than 71 GHz and not more than 86 GHz employs the low band as a band for receiving an electromagnetic wave and employs the high band as a band for transmitting an electromagnetic wave. Obviously, the radio transmitter-receiver can have a configuration opposite to the above configuration.

Therefore, a mode conversion section of a post-wall waveguide included in such a radio transmitter-receiver is classified into (i) a mode conversion section which focuses on a reflection characteristic in the low band (hereinafter, referred to as a low-band mode conversion section) and (ii) a mode conversion section which focuses on a reflection characteristic in the high band (hereinafter, referred to as a high-band mode conversion section).

According to a reflection characteristic (frequency dependence of an S-parameter S11) of a mode conversion section which has a distance $D_{BS}$ that is optimized depending on a center frequency $f_c$ as described above, a peak frequency, which is a frequency at which the S-parameter S11 is minimized, is located in a vicinity of the center frequency $f_c$. Further, as a frequency deviates from the peak frequency toward a low frequency side or a high frequency side, the S-parameter S11 is increased.

A degree with which the S-parameter S11 is increased as the frequency deviates from the peak frequency is greater on a low band side than on a high band side. Therefore, the mode conversion section whose design parameters are optimized based on the center frequency f may not satisfy a criterion which the mode conversion section should satisfy as a low-band mode conversion section, while satisfying a criterion which the mode conversion section should satisfy as a high-band mode conversion section.

In such a case, it is possible to improve the reflection characteristic in the low band by causing a value of the distance $D_{BS}$ to be greater than a reference value which is an optimized value (that is, by forming a blind via farther away from a short wall) so that the center frequency is shifted toward the low frequency side. That is, by adjusting, as appropriate, the distance $D_{BS}$ within a range exceeding the reference value, it is possible to cause the mode conversion section to satisfy the criterion which a low-band mode conversion section should satisfy.

By the way, there is a demand that, in a post-wall waveguide, a width W be reduced. This is to further reduce a size of an integrated substrate on which a transmission device and an electronic component are integrated (substrate of a radio transmitter-receiver).

In a case where the width W is reduced, a cut-off frequency $f_{co}$ of the post-wall waveguide is shifted toward a high frequency side. Thus, as the width W is reduced, the cut-off frequency $f_{co}$ of the post-wall waveguide is caused to be closer to a lower limit of an operation band.

Also in a post-wall waveguide in which a width W is thus reduced, a reflection characteristic in the low band is inferior to that in the high band. Therefore, as with the case of a post-wall waveguide in which a width W is not reduced, it is required that the reflection characteristic in the low band be improved. Under the circumstances, the inventor of the present invention strived to improve the reflection characteristic in the low band by causing a value of a distance $D_{BS}$ to be greater than a reference value which is an optimized value. However, in a case of the post-wall waveguide in which the width W is reduced, this method for improving a reflection characteristic in the low band did not work, and it was not possible to achieve a good reflection characteristic in the low band.

The present invention has been made in view the above problems, and an object of the present invention is to provide a dielectric waveguide having a good reflection characteristic also in a band on a low frequency side of a center frequency $f_c$ of a given operation band.

Solution to Problem

In order to attain the above object, the dielectric waveguide in accordance with an aspect of the present invention is a dielectric waveguide including: a first wide wall; a second wide wall; a first narrow wall; a second narrow wall; a short wall; and a mode conversion section, the first wide wall, the second wide wall, the first narrow wall, the second narrow wall, and the short wall defining a waveguide region which has a rectangular cross section or a substantially rectangular cross section and which is filled with a dielectric, the mode conversion section including a columnar conductor which extends from a surface of the waveguide region toward an inside of the waveguide region in a state where the columnar conductor is apart from a contour of an opening provided in the first wide wall so as to be located in a vicinity of the short wall, a width of the short wall being greater than a distance between the first narrow wall and the second narrow wall at a location at which the columnar conductor is provided.

Advantageous Effects of Invention

According to an aspect of the present invention, it is possible to provide a dielectric waveguide having a good reflection characteristic also in a band on a low frequency side of a center frequency of a given operation band.

BRIEF DESCRIPTION OF DRAWINGS (a) of FIG. 1 is a perspective view of a conductor film surrounding dielectric waveguide in accordance with Embodiment 1 of the present invention. (b) of FIG. 1 is a plan view of the conductor film surrounding dielectric waveguide. (c) of FIG. 1 is a cross-sectional view of the conductor film surrounding dielectric waveguide.

(a) of FIG. 2 is a plan view of a post-wall waveguide in accordance with Variation 1 of the present invention. (b) of FIG. 2 is a cross-sectional view of the post-wall waveguide.

(a) of FIG. 3 is a plan view of a conductor film surrounding dielectric waveguide in accordance with Variation 2 of the present invention. (b) of FIG. 3 is a cross-sectional view of the conductor film surrounding dielectric waveguide.

(a) of FIG. 4 is a plan view of a post-wall waveguide in accordance with Variation 3 of the present invention. (b) of FIG. 4 is a cross-sectional view of the post-wall waveguide.

DESCRIPTION OF EMBODIMENTS

Embodiment 1

(Configuration of Conductor Film Surrounding Dielectric Waveguide 1)

Figure 1:
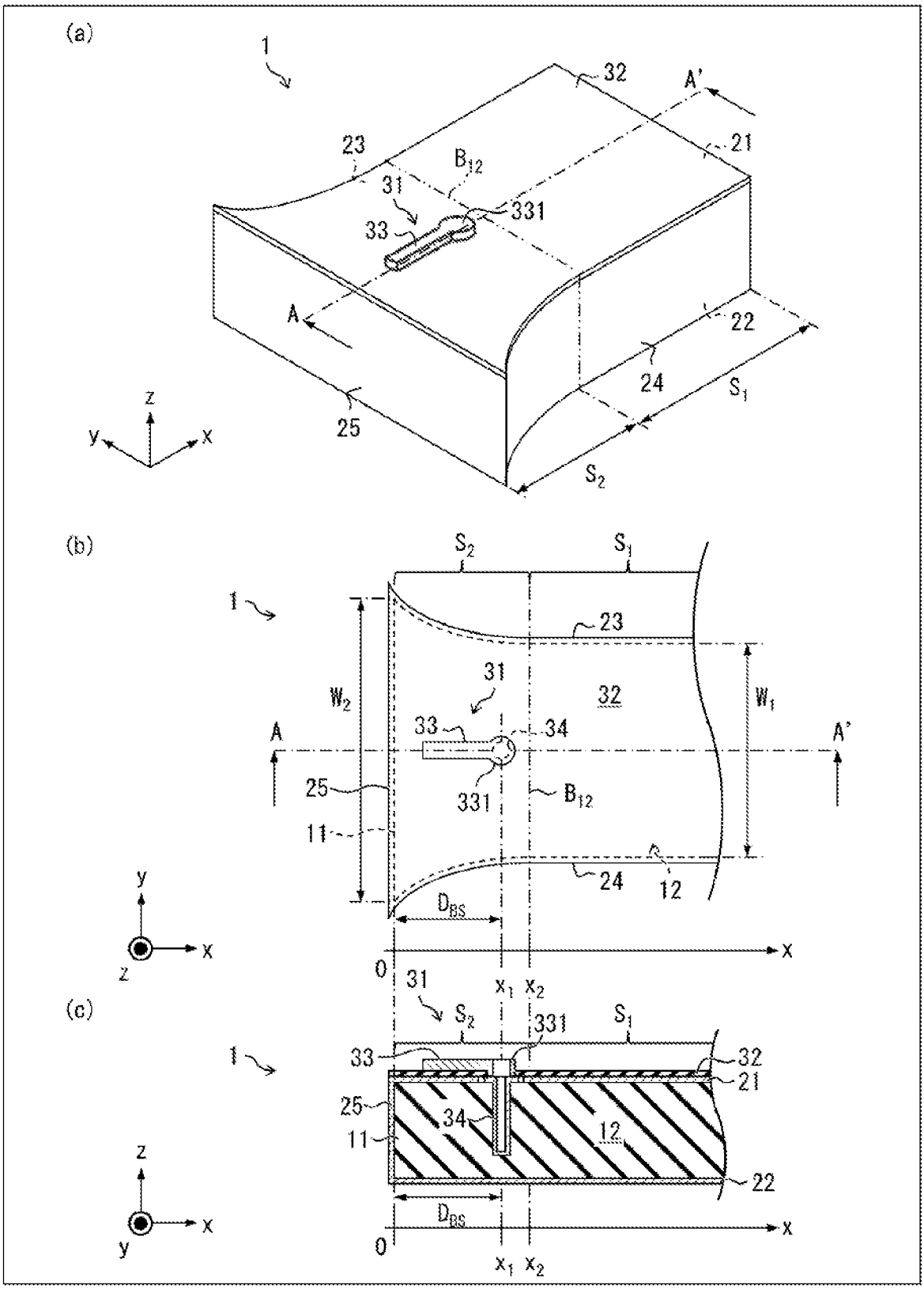

A conductor film surrounding dielectric waveguide in accordance with Embodiment 1 of the present invention will be described below with reference to FIG. 1. (a) of FIG. 1 is a perspective view of the conductor film surrounding dielectric waveguide 1 in accordance with Embodiment 1. (b) of FIG. 1 is a plan view of the conductor film surrounding dielectric waveguide 1. (c) of FIG. 1 is a cross-sectional view of the conductor film surrounding dielectric waveguide 1. Specifically, (c) of FIG. 1 is a cross-sectional view at a cross section which includes an AA' line illustrated in (a) of FIG. 1 and which is perpendicular to a first wide wall 21 and a second wide wall 22 (later described).

Note that a coordinate system illustrated in each of (a), (b), and (c) of FIG. 1 is defined as follows. An axis parallel to a line normal to two main surfaces of a substrate 11 (later described) is defined as a z axis. A direction in which the substrate 11, which is long slender, extends is defined as an x axis. A direction perpendicular to each of the z axis and the x axis is defined as a y axis. Further, in regard to the z axis, a direction from, out of the two main surfaces of the substrate 11, a main surface on which a dielectric layer 32 (later described) is not provided toward a main surface on which the dielectric layer 32 is provided is defined as a positive direction of the z axis (z-axis positive direction). In regard to the x axis, a direction from a short wall 25 (later described) toward an opposite side is defined as a positive direction of the x axis (x-axis positive direction). A positive direction of the y axis (y-axis positive direction) is defined so as to constitute a right-hand system together with the z-axis positive direction and the x-axis positive direction.

As illustrated in (a) through (c) of FIG. 1, the conductor film surrounding dielectric waveguide 1 includes the substrate 11, a conductor layer which covers surfaces of the substrate 11, and a mode conversion section 31. The conductor layer has parts referred to as the first wide wall 21, the second wide wall 22, a first narrow wall 23, a second narrow wall 24, and the short wall 25 depending on which one of the surfaces of the substrate 11 each of the parts of the conductor layer is provided.

The surfaces of the substrate 11 are thus covered with the conductor layer. In this specification, a dielectric waveguide like the dielectric waveguide 1 will be referred to as a conductor film surrounding dielectric waveguide. The conductor film surrounding dielectric waveguide is one of modes of a dielectric waveguide recited in Claims. Note that the dielectric waveguide recited in the Claims encompasses, in its scope, the conductor film surrounding dielectric waveguide and a post-wall waveguide (later described in, for example, Variation 1 (see FIG. 2)).

(Substrate 11)

As illustrated in (a) of FIG. 1, the substrate 11 is a long slender plate-shaped member made of a dielectric. The substrate 11 has six surfaces. Out of the six surfaces, two surfaces each of which has the largest area are the two main surfaces of the substrate 11. Out of the six surfaces, surfaces each of which intersects with the two main surfaces (in Embodiment 1, perpendicular to the two main surfaces) and which constitute an outer edge of the substrate 11 when the substrate 11 is viewed from above will be hereinafter referred to as side surfaces. The side surfaces includes (i) a first side surface which is a side surface located in the y-axis positive direction, (ii) a second side surface which is a side surface located in a negative direction of the y axis (y-axis negative direction), and (iii) a third end surface which is a side surface located in a negative direction of the x-axis (x-axis negative direction). Note that, as illustrated in (b) and (c) of FIG. 1, a location of the third side surface of the substrate 11 in an x-axis direction is set as a point of origin of the x axis. Note also that, in Embodiment 1, the substrate 11 has a transverse cross section (cross section extending along a yz plane) in the shape of a rectangle. The substrate 11 constitutes a waveguide region 12 (later described). Therefore, the conductor film surrounding dielectric waveguide 1 is a rectangular waveguide configured such that the waveguide region 12 has a transverse cross section in the shape of a rectangle.

Note that, in Embodiment 1, a description that the substrate 11 (that is, the waveguide region 12) has a transverse cross section in the shape of a rectangle has been given. However, the transverse cross section of the substrate 11 can alternatively have a shape obtained by cutting off each of four corners of a rectangle along a smooth curved line or a straight line. A shape obtained by cutting off each of four corners of a rectangle along a smooth curved line is a rounded rectangular shape. A shape obtained by cutting off each of four corners of a rectangle along a straight line is an octagonal shape when microscopically viewed, but is a rectangular shape when macroscopically viewed. An expression "substantially rectangular" recited in the Claims indicates (i) the above-described rounded rectangular shape and (ii) a shape which is an octagonal shape when microscopically viewed but is a rectangular shape when macroscopically viewed.

As illustrated in (b) of FIG. 1, the substrate 11 has (i) a first section $S_1$ in which a width $W_1$ of the substrate 11 is uniform when the substrate 11 is viewed from above and (ii) a second section $S_2$ in which the width $W_1$ of the substrate 11 is made continuously greater toward the third side surface (a side surface located in the x-axis negative direction) of the substrate 11 when the substrate 11 is viewed from above. Therefore, the second section $S_2$ is formed so as to be tapered. Note that, in each of (a) through (c) of FIG. 1, a boundary between the first section $S_1$ and the second section $S_2$ is illustrated with use of a chain double-dashed line. As illustrated in (b) and (c) of FIG. 1, a location of the boundary is represented by $x_2$.

In Embodiment 1, quartz is employed as the dielectric of which the substrate 11 is made. Note, however, that any other dielectric (for example, a resin material such as a polytetrafluoroethylene-based resin or a liquid crystal polymer resin) can be alternatively employed as the dielectric of which the substrate 11 is made.

(Conductor Layer)

As illustrated in (a) and (b) of FIG. 1, the first wide wall 21 and the second wide wall 22, each of which is one of the parts of the conductor layer that covers the surfaces of the substrate 11, are respectively provided on the two main surfaces of the substrate 11, and constitute a pair of wide walls of the conductor film surrounding dielectric waveguide 1. The first narrow wall 23 and the second narrow wall 24, each of which is one of the parts of the conductor layer, are respectively provided on the first side surface and the second side surface of the substrate 11, and constitute a pair of narrow walls of the conductor film surrounding dielectric waveguide 1. The short wall 25, which is one of the parts of the conductor layer, is provided on the third side surface of the substrate 11. In Embodiment 1, the short wall 25 is perpendicular to the first wide wall 21 and the second wide wall 22, and is also perpendicular to the first narrow wall 23 and the second narrow wall 24 in the first section $S_1$. The substrate 11, whose surfaces are covered with the conductor film, constitutes the waveguide region 12 in which an electromagnetic wave in a given operation band is guided in the x-axis direction. Therefore, the width $W_1$ of the substrate 11 is equal to a distance between the first narrow wall 23 and the second narrow wall 24, and can be also expressed as a width $W_1$ of the waveguide region 12. The width $W_1$ of the waveguide region 12 corresponds to a waveguide width recited in the Claims.

As has been described, the substrate 11 has the first section $S_1$ and the second section $S_2$, and the second section $S_2$ is formed so as to be widened in the x-axis negative direction and accordingly have a tapered shape. Therefore, in a case where, from a region in which $x>x_2$, a location x becomes closer to a location at which x=0 (in the x-axis negative direction), the width $W_1$ of the waveguide region 12 is (1) uniform in the first section $S_1$ (a section in which $x_2 \leq x$), (2) made greater in the second section $S_2$ (a section in which $0 \leq x < x_2$), and (3) equal to a width $W_2$ of the short wall 25 at an end of the second section $S_2$ at which end $x=0$. A columnar conductor 34 (later described) is provided so that a location $x_1$ of the columnar conductor 34 satisfies a condition that $0 < x_1 < x_2$. Thus, the width $W_2$ of the short wall 25 is greater than the width $W_1$ of the waveguide region 12 at the location $x_1$ at which the columnar conductor 34 (later described) is provided.

Since the surfaces of the substrate 11 are covered with the conductor layer, a high-frequency wave having a frequency equal to or higher than a cut-off frequency $f_{co}$ is confined within the substrate 11. Therefore, the substrate 11 functions as the waveguide region 12 of the conductor film surrounding dielectric waveguide 1. An electromagnetic wave having been inputted in the conductor film surrounding dielectric waveguide 1 through a microstrip line with use of the mode conversion section 31 (later described) propagates inside the substrate 11 in the x-axis positive direction. Similarly, an electromagnetic wave having propagated inside the substrate 11 in the x-axis negative direction is outputted to the microstrip line with use of the mode conversion section 31.

In Embodiment 1, copper is employed as a conductor of which each of the first wide wall 21, the second wide wall 22, the first narrow wall 23, the second narrow wall 24, and the short wall 25 is made. Note, however, that any other conductor (for example, metal such as aluminum) can be alternatively employed. Note also that a thickness of the conductor film which constitutes the first wide wall 21, the second wide wall 22, the first narrow wall 23, the second narrow wall 24, and the short wall 25 is not limited, and any thickness can be employed. That is, the conductor film can take any one of forms referred to as a thin film, foil (film), and a plate. Each of the thin film, the foil (film), and the plate has such a thickness that the thin film is the thinnest, the foil (film) is thicker than the thin film, and the plate is thicker than the foil (film).

(Mode Conversion Section 31)

As illustrated in (b) and (c) of FIG. 1, the mode conversion section 31 includes the first wide wall 21, the dielectric layer 32, a signal line 33, and the columnar conductor 34.

The dielectric layer 32 is stacked on a surface of the first wide wall 21 so as to cover the surface of the first wide wall 21. In Embodiment 1, the dielectric layer 32 is made of polyimide resin. Note that a material of which the dielectric layer 32 is made is not limited to the polyimide resin, and only needs to be a material which functions as a dielectric.

A blind via is provided in a vicinity of the short wall 25 so as to extend toward an inside of the substrate 11 from one (a surface of a waveguide region in the Claims) of the main surfaces of the substrate 11 on which one the first wide wall is provided (which one is located in the z-axis positive direction). A conductor film (made of copper in Embodiment 1) is provided on an inner wall of the blind via. The conductor film constitutes the columnar conductor 34. The blind via is located at $x_1$ in the x-axis direction and at a middle point of the width $W_1$ of the waveguide region 12 in the y-axis direction. In Embodiment 1, $x_1 < x_2$. That is, the columnar conductor 34 is provided within the second section $S_2$. However, a location in the x-axis direction at which location the columnar conductor 34 is provided is not limited to a location at which $x_1 < x_2$, and can be alternatively a location at which $x_1 = x_2$ or $x_1 > x_2$. Note that a distance between the short wall 25 and the columnar conductor 34 (that is, the location $x_1$ in the x-axis direction) will be hereinafter referred to as a distance $D_{BS}$.

An anti-pad (a contour of an opening in the Claims) is provided in a region of the first wide wall 21 which region includes the columnar conductor 34 when viewed from above. A pad is provided inside the anti-pad so as to be apart from the first wide wall 21. This pad is electrically continuous with the columnar conductor 34.

The dielectric layer 32 has an opening at a location which includes the columnar conductor 34 when viewed from above.

In Embodiment 1, the columnar conductor 34, the pad, the anti-pad, and the opening in the dielectric layer 32 are concentrically disposed when viewed from above.

The signal line 33 is provided on a surface of the dielectric layer 32. The signal line 33 is a strip-shaped conductor, and is disposed so that a lengthwise direction of the signal line 33 matches the x-axis direction. One of end parts, that is, an end part 331 of the signal line 33 has a circular shape having a diameter greater than that of the columnar conductor 34. The end part 331 is electrically continuous with the columnar conductor 34 via the pad. The signal line 33 is disposed so that (i) the end part 331 is superposed on the columnar conductor 34 and the pad when viewed from above and (ii) the signal line 33 itself extends toward the short wall 25 from the end part 331 (in the x-axis negative direction).

In the mode conversion section 31 configured as described above, the signal line 33 and the first wide wall 21 constitutes a microstrip line. The columnar conductor 34 allows a conversion between (1) a mode in which an electromagnetic wave propagates inside the microstrip line and (2) a mode in which the electromagnetic wave propagates inside the substrate 11, which is the waveguide region 12 of the conductor film surrounding dielectric waveguide 1. Therefore, the mode conversion section 31 functions as a mode conversion section which converts a mode in the microstrip line into a mode in the substrate 11, and vice versa. In other words, the mode conversion section 31 functions as a first port which is one of input-output ports of the conductor film surrounding dielectric waveguide 1.

Note that, in Embodiment 1, the configuration of the conductor film surrounding dielectric waveguide 1 has been described with reference to merely the first port (port in the x-axis negative direction) of the conductor film surrounding dielectric waveguide 1 (FIG. 1). A second port (port in the x-axis positive direction) which is the other of the input-output ports of the conductor film surrounding dielectric waveguide 1 can be configured similarly to the first port. Alternatively, the second port can be directly connected to a transmission device such as a directional coupler or a diplexer.

(Reflection Characteristic of Mode Conversion Section 31)

According to the mode conversion section 31 configured as described above, it is possible to control a reflection characteristic (in other words, a transmission characteristic) by adjusting, for example, the distance $D_{BS}$, the width $W_2$ of the short wall, the width $W_1$ of the waveguide region 12, a thickness of the waveguide region 12, and a length of the columnar conductor 34, which are design parameters. The reflection characteristic indicates frequency dependence of an S-parameter S11, and the transmission characteristic indicates frequency dependence of an S-parameter S21.

Design parameters of a conventional conductor film surrounding dielectric waveguide, that is, a conductor film surrounding dielectric waveguide which is configured such that a width of a waveguide region is uniform throughout the whole section and the width of the waveguide region is equal to a width of a short wall are determined, for example, as follows.

Out of the design parameters, a width $W_1$ which is a design parameter concerning the waveguide region is basically determined based on a given operation band. Note that a thickness of the waveguide region is equal to a thickness of a substrate 11, and is automatically determined at a time point at which the substrate 11 to be used is determined.

As the width $W_1$, a width has been employed so far which is equal to a guide wavelength that corresponds to a cut-off frequency $f_{co}$ obtained by dividing a center frequency f of the given operation band by 1.5. For example, in a case where the given operation band is not less than 71 GHz and not more than 86 GHz, $f_c$=78.5 GHz and a width which is equal to a guide wavelength (=1.54 mm) corresponding to $f_{co}$=52.33 GHz has been employed as the width of the waveguide region.

As described in the section "Background Art", according to a conductor film surrounding dielectric waveguide in which a width of a waveguide region is determined based on a cut-off frequency $f_{co}$ obtained by dividing a center frequency $f_c$ by 1.5, it is found that it is possible to improve a reflection characteristic in a low band by setting a distance $D_{BS}$ so that a value of the distance $D_{BS}$ is greater than a reference value which is an optimized value. In the section "Background Art", this fact has been described with reference to a post-wall waveguide. However, also in a conductor film surrounding dielectric waveguide, adjusting a distance $D_{BS}$ is effective in controlling a reflection characteristic.

However, as described in the section "Technical Problem", in recent years, there has been a demand that a size of a waveguide be reduced. This demand is synonymous with a demand that, in a conductor film surrounding dielectric waveguide, a width of a waveguide region be reduced. In a case where a width of a waveguide region is reduced (for example, in a case where 1.32 mm is employed as the width of the waveguide region), a cut-off frequency $f_{co}$ of a conductor film surrounding dielectric waveguide is shifted toward a high frequency side. Thus, as a width of a waveguide region is reduced, a cut-off frequency $f_{co}$ of a conductor film surrounding dielectric waveguide becomes closer to a lower limit of an operation band.

In a case where, in a conductor film surrounding dielectric waveguide in which a width of a waveguide region is reduced, a distance $D_{BS}$ is set so that the value of the distance $D_{BS}$ is greater than a reference value which is an optimized value, it is not possible to improve a reflection characteristic in the low band, as later described as results of Comparative Examples (see FIG. 6).

(Effects of Conductor Film Surrounding Dielectric Waveguide 1)

According to the conductor film surrounding dielectric waveguide 1 in accordance with Embodiment 1, it is possible to solve the above problem by designing the width $W_2$ of the short wall 25 so that the width $W_2$ of the short wall 25 is greater than the width $W_1$ at the location $x_1$ at which the columnar conductor 34 is provided. For example, in Embodiment 1, it is possible to improve the reflection characteristic in the low band by setting (i) the width $W_1$ in the first section so that $W_1$=1.32 mm and (ii) the width $W_2$ so that $W_2$=1.8 mm.

Therefore, the conductor film surrounding dielectric waveguide 1 exhibits a good reflection characteristic also in a band on a low frequency side of a center frequency f of the given operation band, even in a case where the width $W_1$ of the waveguide region 12 is designed so that the width $W_1$ is narrower than a conventional width (that is, the cut-off frequency becomes closer to a lower limit of the operation band). For example, in a case where (i) the given operation band is a band of not less than 71 GHz and not more than 86 GHz, which is part of the E band, and (ii) the center frequency $f_c$ of the given operation band is 78.5 GHz, the conductor film surrounding dielectric waveguide 1 exhibits a good reflection characteristic also in the low band (not less than 71 GHz and not more than 76 GHz) which is a band on the low frequency side of 78.5 GHz.

As has been described, according to the conductor film surrounding dielectric waveguide 1, it is possible to design the width $W_1$ so that the width $W_1$ is narrower than the conventional width. A technique of designing a width $W_2$ so that the width $W_2$ is greater than a width $W_1$ in a conductor film surrounding dielectric waveguide which includes a mode conversion section as described above is applicable to any transmission device (for example, a directional coupler and a diplexer) which includes a conductor film surrounding dielectric waveguide as a waveguide. That is, making the width $W_2$ greater than the width $W_1$ allows not only the conductor film surrounding dielectric waveguide but also a directional coupler and a diplexer to each have a reduced size.

Furthermore, according to the conductor film surrounding dielectric waveguide 1, in the second section $S_2$, the width $W_1$ of the waveguide region 12 is made continuously greater from the boundary between the second section $S_2$ and the first section $S_1$ toward the short wall 25. According to this configuration, the second section $S_2$ does not include such a part that the width $W_1$ is sharply (discontinuously) varied. In other words, the second section $S_2$ does not include such a part that characteristic impedance is sharply (discontinuously) varied. Therefore, according to the conductor film surrounding dielectric waveguide 1, it is possible to suppress a return loss which can occur in a case where the width $W_1$ is made greater in the second section $S_2$.

Moreover, it is possible to apply, to not only a conductor film surrounding dielectric waveguide but also a post-wall waveguide (for example, see FIG. 2), the technique of designing a width $W_2$ so that the width $W_2$ is greater than a width $W_1$ at a location $x_1$, as later described in Variation 1. A post-wall waveguide to which the technique is applied brings about an effect similar to that brought about by the conductor film surrounding dielectric waveguide 1 in accordance with Embodiment 1. That is, it is possible to suitably employ, for a dielectric waveguide (synonymous with the dielectric waveguide recited in the Claims) which encompasses a conductor film surrounding dielectric waveguide and a post-wall waveguide in a broad sense, the technique of designing a width $W_2$ so that the width $W_2$ is greater than a width $W_1$.

[Variation 1]

In Embodiment 1, the present invention has been described with reference to, as an example, the conductor film surrounding dielectric waveguide 1 which is configured such that the substrate 11 constitutes the waveguide region 12 and the conductor film which covers the surfaces of the substrate 11 constitutes the first and second wide walls 21 and 22 (the pair of wide walls), the first and second narrow walls 23 and 24 (the pair of narrow walls), and the short wall 25.

Figure 2:
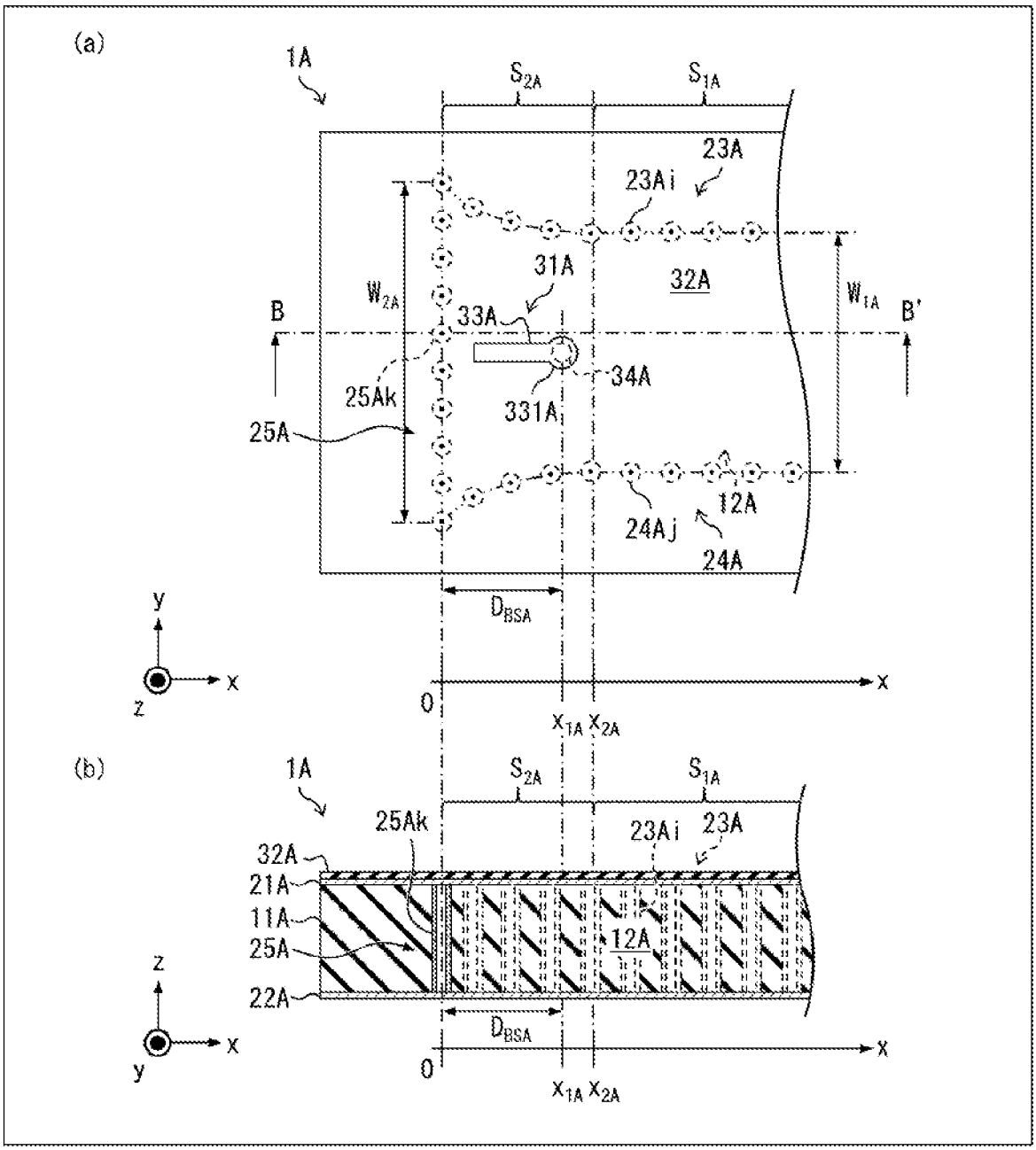

In Variation 1 of the present invention, a post-wall waveguide having a configuration which is similar to that of the conductor film surrounding dielectric waveguide 1 and which is realized with use of a technique of a post wall will be described with reference to FIG. 2. The post-wall waveguide, typified by a post-wall waveguide 1A, is one of the modes of the dielectric waveguide recited in Claims. (a) of FIG. 2 is a plan view of the post-wall waveguide 1A in accordance with Variation 1. (b) of FIG. 2 is a cross-sectional view of the post-wall waveguide 1A. Specifically, (b) of FIG. 2 is a cross-sectional view at a cross section which includes a BB' line illustrated in (a) of FIG. 2 and which is perpendicular to a first wide wall 21A and a second wide wall 22A (later described). Note that a coordinate system illustrated in each of (a) and (b) of FIG. 2 is defined similarly to that illustrated in each of (a), (b), and (c) of FIG. 1.

Reference signs of members included in the post-wall waveguide 1A are derived by putting a letter "A" after ends of reference signs of members included in the conductor film surrounding dielectric waveguide 1. Note that, in Variation 1, only part of the configuration of the post-wall waveguide 1A which is part is different from the conductor film surrounding dielectric waveguide 1 will be described and part of the configuration of the post-wall waveguide 1A which is part is identical to the conductor film surrounding dielectric waveguide 1 will not be described.

(Configuration of Post-Wall Waveguide 1A)

As illustrated in (a) and (b) of FIG. 2, the post-wall waveguide 1A includes a substrate 11A, a first conductor film 21A, a second conductor film 22A, and a mode conversion section 31A which includes a dielectric layer 32A. The mode conversion section 31A is configured similarly to the mode conversion section 31 of the conductor film surrounding dielectric waveguide 1 illustrated in FIG. 1.

The substrate 11A is made of quartz similarly to the substrate 11. However, the substrate 11A is different from the substrate 11 in the following point.

The substrate 11 is a long slender plate-shaped member (see FIG. 1), and has (i) the first section $S_1$ in which the width $W_1$ is uniform and (ii) the second section $S_2$ in which the width $W_1$ is made continuously greater toward the third side surface (side surface on which the short wall 25 is provided).

In contrary, as illustrated in (a) of FIG. 2, although the substrate 11A is a long slender plate-shaped member, an overall width of the substrate 11A is greater than each of a width $W_{1A}$ of a waveguide region 12A and a width $W_{2A}$ of a short wall 25A (each later described).

The first conductor film 21A is a conductor film provided on one of main surfaces of the substrate 11A (a main surface that is located on a side on which the dielectric layer 32A (later described) is provided and that is located in a z-axis positive direction).

The second conductor film 22A is a conductor film provided on the other of the main surfaces of the substrate 11A (a main surface that is located in a negative direction of the z axis (z-axis negative direction)).

The first conductor film 21A and the second conductor film 22A constitute a pair of wide walls which define the waveguide region 12A of the post-wall waveguide 1A. Therefore, the first conductor film 21A and the second conductor film 22A are hereinafter also referred to as the first wide wall 21A and the second wide wall 22A, respectively.

A first narrow wall 23A and a second narrow wall 24A, which constitute a pair of narrow walls, and the short wall 25A define the waveguide region 12A together with the first wide wall 21A and the second wide wall 22A. The first narrow wall 23A, the second narrow wall 24A, and the short wall 25A are constituted by a post wall (see FIG. 2).

The post wall constituting the first narrow wall 23A, the second narrow wall 24A, and the short wall 25A is one that is obtained by arranging a plurality of conductor posts at given intervals in a fence-like manner. The first narrow wall 23A is constituted by conductor posts 23Ai which are part of the plurality of conductor posts. The second narrow wall 24A is constituted by conductor posts 24Aj which are part of the plurality of conductor posts. The short wall 25A is constituted by conductor posts 25Ak which are part of the plurality of conductor posts. Note, here, that each of i, j, and k is one that generalizes the number of conductor posts. In a case where $M<N$ (each of M and N is any positive integer), each of i and j satisfies a condition that $1<i,j\leq N$ (each of i and j is a positive integer), and k satisfies a condition that $1<k\leq M$ (k is a positive integer).

When the substrate 11A is viewed from above, the post wall which is constituted by the plurality of conductor posts (the conductor posts 23Ai, the conductor posts 24Aj, and the conductor posts 25Ak) and which has a fence-like shape is provided within the substrate 11A (see (a) of FIG. 2). The conductor posts 23Ai constitute the first narrow wall 23A. The conductor posts 24Aj constitute the second narrow wall 24A. The conductor posts 25Ak constitute the short wall 25A. The first narrow wall 23A, the second narrow wall 24A, and the short wall 25A correspond to the first narrow wall 23, the second narrow wall 24, and the short wall 25, respectively, of the conductor film surrounding dielectric waveguide 1 illustrated in FIG. 1. The first narrow wall 23A constituted by the conductor posts 23Ai functions as an imaginary conductor wall which reflects an electromagnetic wave having a wavelength equal to or higher than a given wavelength, depending on a distance between adjacent ones of the conductor posts 23Ai. An imaginary reflecting surface of this conductor wall is formed along a surface including a central axis of each of the conductor posts 23Ai. In (a) of FIG. 2, the imaginary reflecting surface of the first narrow wall 23A is illustrated with use of an imaginary line (chain double-dashed line). Similarly, in (a) of FIG. 2, an imaginary reflecting surface of the second narrow wall 24A and an imaginary reflecting surface of the short wall 25A are each also illustrated with use of an imaginary line (chain double-dashed line).

According to the post-wall waveguide 1A, the waveguide region 12A is constituted by a region surrounded by (i) the first wide wall 21A and the second wide wall 22A (the pair of wide walls), each of which is constituted by the conductor film, (ii) the imaginary reflecting surfaces of the first narrow wall 23A and the second narrow wall 24A (the pair of narrow walls), which are constituted by the post wall, and (iii) the imaginary reflecting surface of the short wall 25A, which is constituted by the post wall. When the substrate 11A is viewed from above, the conductor posts 23Ai, the conductor posts 24Aj, and the conductor posts 25Ak are disposed such that a shape of an edge of the waveguide region 12A of the post-wall waveguide 1A matches a shape of the waveguide region (that is, a shape of the substrate 11) of the conductor film surrounding dielectric waveguide 1 illustrated in FIG. 1.

In Variation 1, each of those conductor posts is constituted by a conductor film which has a tubular shape and which is provided on an inner wall of a via (through hole) passing through the substrate 11A from one to the other of the main surfaces of the substrate 11A. The conductor film is made of metal (for example, copper). Note that each of the conductor posts can be constituted by a conductor rod which has a cylindrical shape and which is obtained by filling an inside of the via with a conductor (for example, metal).

According to the post-wall waveguide 1A thus configured, the width $W_{2A}$ of the short wall 25A is greater than the width $W_{1A}$ (the waveguide width recited in the Claims) of the waveguide region 12A at a location $x_{1A}$ at which a columnar conductor 34A is provided, similarly to the conductor film surrounding dielectric waveguide 1.

The post-wall waveguide 1A has a first section $S_{1A}$ and a second section $S_{2A}$. The first section $S_{1A}$ is a section in which the width $W_{1A}$ is uniform. The second section $S_{2A}$ is a section having end parts, one (in an x-axis positive direction) of which is connected to one (in an x-axis negative direction) of end parts of the first section $S_{1A}$ and the other of which is terminated by the short wall 25A. In the second section $S_{2A}$, the width $W_1$ is made continuously greater toward the short wall 25A (location at which x=0) from a boundary (location at which $x=x_{2A}$) between the first section $S_{1A}$ and the second section $S_{2A}$.

(Effects of Post-Wall Waveguide 1A)

The post-wall waveguide 1A, which employs the technique of a post wall, has the following advantages. That is, the post-wall waveguide 1A is low in production cost, small in size, and light in weight, as compared with a waveguide having a waveguide wall constituted by a metal plate. Moreover, the post-wall waveguide 1A allows a transmission device, such as a filter, a directional coupler, and a diplexer, in addition to the waveguide, to be integrated on a single substrate. Furthermore, it is possible to easily mount various electronic components (for example, a resistor, a capacitor, and a high-frequency circuit) on a surface of the substrate. Therefore, as compared with the conductor film surrounding dielectric waveguide 1, the post-wall waveguide LA allows an increase in degree of integration in a case where a transmission device and an electronic component are integrated.

The post-wall waveguide 1A brings about effects identical to those brought about by the conductor film surrounding dielectric waveguide 1 illustrated in FIG. 1, in addition to the above effects resulting from a fact that it is possible to produce the post-wall waveguide LA by the technique of a post-wall waveguide. Therefore, descriptions of the effects will be omitted here.

[Variations 2 and 3]

In each of Embodiment 1 and Variation 1, an example in which the first narrow wall and the second narrow wall form a tapered shape is described. Variations 2 and 3 which are derived from Embodiment 1 and Variation 1, respectively, and in each of which any one of a first narrow wall 23 and a second narrow wall 24 forms a tapered shape will be described with reference to the drawings. Note that, for convenience, members identical in function to members described in Embodiment 1 and Variation 1 will be given identical reference signs, and description of such members will be omitted.

(Configuration of Conductor Film Surrounding Dielectric Waveguide 1B)

Figure 3:
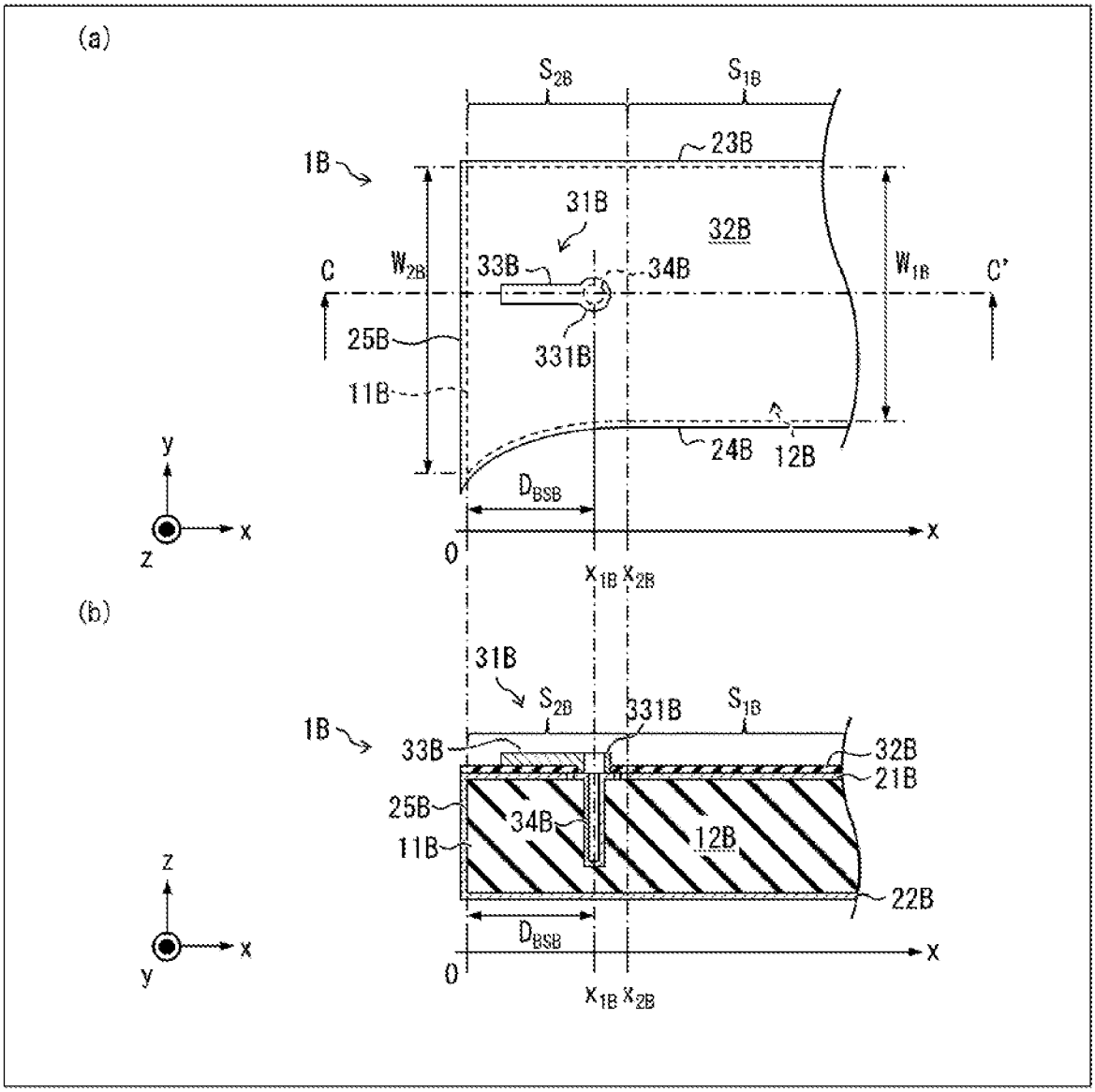

(a) of FIG. 3 is a plan view of a conductor film surrounding dielectric waveguide 1B in accordance with Variation 2 of the present invention. (b) of FIG. 3 is a cross-sectional view of the conductor film surrounding dielectric waveguide 1B. Specifically, (b) of FIG. 3 is a cross-sectional view at a cross section which includes a CC' line illustrated in (a) of FIG. 3 and which is perpendicular to a first wide wall 21B and a second wide wall 22B (later described). As illustrated in (a) and (b) of FIG. 3, the conductor film surrounding dielectric waveguide 1B includes a substrate 11B, the first wide wall 21B, the second wide wall 22B, a first narrow wall 23B, a second narrow wall 24B, a short wall 25B, and a mode conversion section 31B. Out of those constituent elements, the substrate 11B, the first wide wall 21B, the second wide wall 22B, the short wall 25B, and the mode conversion section 31B are configured similarly to the substrate 11, the first wide wall 21, the second wide wall 22, the short wall 25, and the mode conversion section 31, respectively, in Embodiment 1. The conductor film surrounding dielectric waveguide 1B, as well as the conductor film surrounding dielectric waveguide 1 illustrated in FIG. 1, is an example of a conductor film surrounding dielectric waveguide.

The first narrow wall 23B is linearly disposed along an x axis, when the conductor film surrounding dielectric waveguide 1B is viewed from above. In contrast, the second narrow wall 24B is disposed so as to be apart from the first narrow wall 23B along a smoothly curved line as the second narrow wall 24B extends from a boundary between a second section $S_{2B}$ and a first section $S_{1B}$ toward the short wall 25B. Therefore, a width $W_2$B of the short wall 25B is greater than a width $W_{1B}$ at a location $x_{1B}$ at which a columnar conductor 34 is provided.

According to the conductor film surrounding dielectric waveguide 1B, it is only necessary that the width $W_{2B}$ be greater than the width $W_{1B}$ at a location $x_{1B}$, and a location of the short wall 25B in a y-axis direction is not limited.

In an aspect of the present invention, a midpoint of the width $W_2$ of the short wall 25 and a midpoint of the width $W_1$ in the first section $S_1$ can coincide with each other in the y-axis direction, as in the conductor film surrounding dielectric waveguide 1 illustrated in FIG. 1. Alternatively, a midpoint of the width $W_{2B}$ of the short wall 25B and a midpoint of the width $W_{1B}$ in the first section SIB can differ from each other in the y-axis direction, as in the conductor film surrounding dielectric waveguide 1B illustrated in (a) of FIG. 3. In a case where, as in the conductor film surrounding dielectric waveguide 1B, the midpoint of the width $W_{2B}$ of the short wall 25B and the midpoint of the width $W_{1B}$ in the first section $S_{1B}$ differ from each other in the y-axis direction, the width $W_{2B}$ (1) can be made greater merely in one of two directions along the y axis (in (a) of FIG. 3, in a y-axis negative direction) as illustrated in (a) of FIG. 3 or (2) can be alternatively made greater in the two directions along the y axis (in a y-axis positive direction and the y-axis negative direction). This also applies to a post-wall waveguide 10 (later described).

(Configuration of Post-Wall Waveguide 1C)

Figure 4:
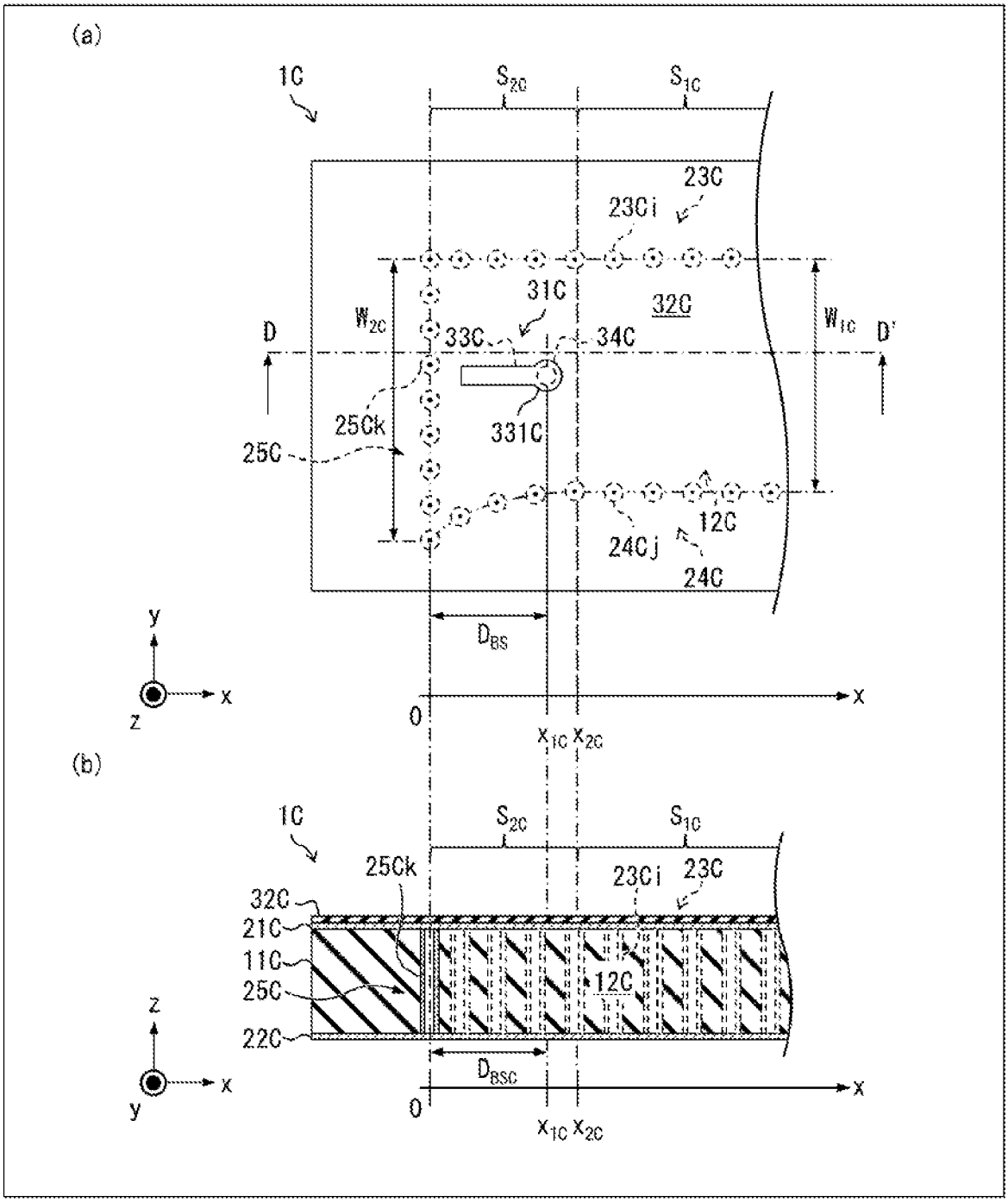

(a) of FIG. 4 is a plan view of a post-wall waveguide 1C in accordance with Variation 3 of the present invention. (b) of FIG. 4 is a cross-sectional view of the post-wall waveguide 1C. Specifically, (b) of FIG. 4 is a cross-sectional view at a cross section which includes a DD' line illustrated in (a) of FIG. 4 and which is perpendicular to a first wide wall 21C and a second wide wall 22C (later described). As illustrated in (a) and (b) of FIG. 4, the post-wall waveguide 1C includes a substrate 11C, the first wide wall 21C, the second wide wall 22C, a first narrow wall 23C, a second narrow wall 24C, a short wall 25C, and a mode conversion section 31C. Out of those constituent elements, the substrate 11C, the first wide wall 21C, the second wide wall 22C, and the mode conversion section 31C are configured similarly to the substrate 11A, the first wide wall 21A, the second wide wall 22A, and the mode conversion section 31A, respectively, of the post-wall waveguide 1A in accordance with Variation 1. Further, the first narrow wall 23C and the second narrow wall 24C (a pair of narrow walls) and the short wall 25C are constituted by a post wall, similarly to the first narrow wall 23A and the second narrow wall 24A (the pair of narrow walls) and the short wall 25A in Variation 1.

The first narrow wall 23C is constituted by conductor posts 23Ci, and constitutes part of the post wall which part corresponds to the first narrow wall 23B illustrated in (a) of FIG. 3. The second narrow wall 24C is constituted by conductor posts 24Cj, and constitutes part of the post wall which part corresponds to the second narrow wall 24B illustrated in (a) of FIG. 3. Therefore, a width $W_{2C}$ of the short wall 25C is greater than a width $W_{1C}$ at a location $x_{1C}$ at which a columnar conductor 34C is provided.

(Major Effects of Conductor Film Surrounding Dielectric Waveguide 1B and Post-Wall Waveguide 1C)

By employing a configuration like that of the conductor film surrounding dielectric waveguide 1B, it is possible to, for example, in a transmission device including two conductor film surrounding dielectric waveguides 1B (first and second conductor film surrounding dielectric waveguides 1B) which are provided in parallel, dispose the first and second conductor film surrounding dielectric waveguides 1B closer to each other. This is because it is possible to dispose the first conductor film surrounding dielectric waveguide 1B and the second conductor film surrounding dielectric waveguide 1B without any gap therebetween, by (i) disposing the first conductor film surrounding dielectric waveguide 1B as illustrated in (a) of FIG. 3 and (ii) disposing the second conductor film surrounding dielectric waveguide 1B so that the first conductor film surrounding dielectric waveguide 1B and the second conductor film surrounding dielectric waveguide 1B are reflectively symmetrical with respect to a zx plane which includes the first narrow wall 23B and which serves as a plane of symmetry. Examples of the transmission device including the two conductor film surrounding dielectric waveguides 1B which are provided in parallel include directional couplers and diplexers. In this point, the post-wall waveguide 1C brings about effects identical to those brought about by the conductor film surrounding dielectric waveguide 1B.

Each of the conductor film surrounding dielectric waveguide 1B and the post-wall waveguide 1C brings about effects identical to those brought about by each of the conductor film surrounding dielectric waveguide 1 illustrated in FIG. 1 and the post-wall waveguide LA illustrated in FIG. 2, in addition to the above effects. Therefore, descriptions of the effects will be omitted here.

EXAMPLES

Example 1 and Example 2

A reflection characteristic (frequency dependence of an S-parameter S11) of each of the post-wall waveguide 1A illustrated in FIG. 2 and the post-wall waveguide 1C illustrated in (b) of FIG. 3 was simulated with use of a model of the post-wall waveguide 1A and a model of the post-wall waveguide 1C. The model of the post-wall waveguide 1A and the model of the post-wall waveguide 1C used for simulations were regarded as Example 1 and Example 2, respectively, of the present invention.

Each of a post-wall waveguide LA of Example 1 and a post-wall waveguide 1C of Example 2 was designed so that an operation band thereof was a band of not less than 71 GHz and not more than 86 GHz, which band is included in the E band, and was particularly designed so that a main operation band thereof was the low band, which is a band of not less than 71 GHz and not more than 76 GHz.

The post-wall waveguide 1A of Example 1 employed, as a substrate 11A, a quartz substrate having a thickness of 520 μm. Conductor films, each made of copper and having a thickness of 10 μm, were provided on respective main surfaces of the substrate 11A. The conductor films functioned as wide walls 21A and 22A.

Conductor posts 23Ai constituting a first narrow wall 23A, conductor posts 24Aj constituting a second narrow wall 24A, and conductor posts 25Ak constituting a short wall 25A were each produced by forming a conductor film, made of copper, on an inner wall of a through-hole via passing through the substrate 11A.

The post-wall waveguide 1A of Example 1 employed the following values as design parameters.

Width: $W_{1A}$=1.32 mm

Cut-off frequency: $f_c$=58.98 GHz

Width: $W_{2A}$=1.8 mm

Distance: $D_{BSA}$=584 μm

Length of second section $S_{2A}$: $x_{2A}$=750 μm

Conventionally, in a case where an operation band is a band of not less than 71 GHz and not more than 86 GHz, a width of 1.54 mm has been employed as the width $W_1$, that is, a frequency of 52.33 GHz has been employed as the cut-off frequency $f_{co}$. In contrary, according to the post-wall waveguide 1A of Example 1, a width of 1.32 mm was employed as the width $W_{1A}$ in the first section $S_{1A}$ so that the waveguide had a reduced size.

According to the post-wall waveguide 1C of Example 2, a width of 1.6 mm was employed as a width $W_{2C}$. As the other design parameters, values identical to those of the design parameters of the post-wall waveguide 1A of Example 1 were employed.

Comparative Examples

Figure 5:
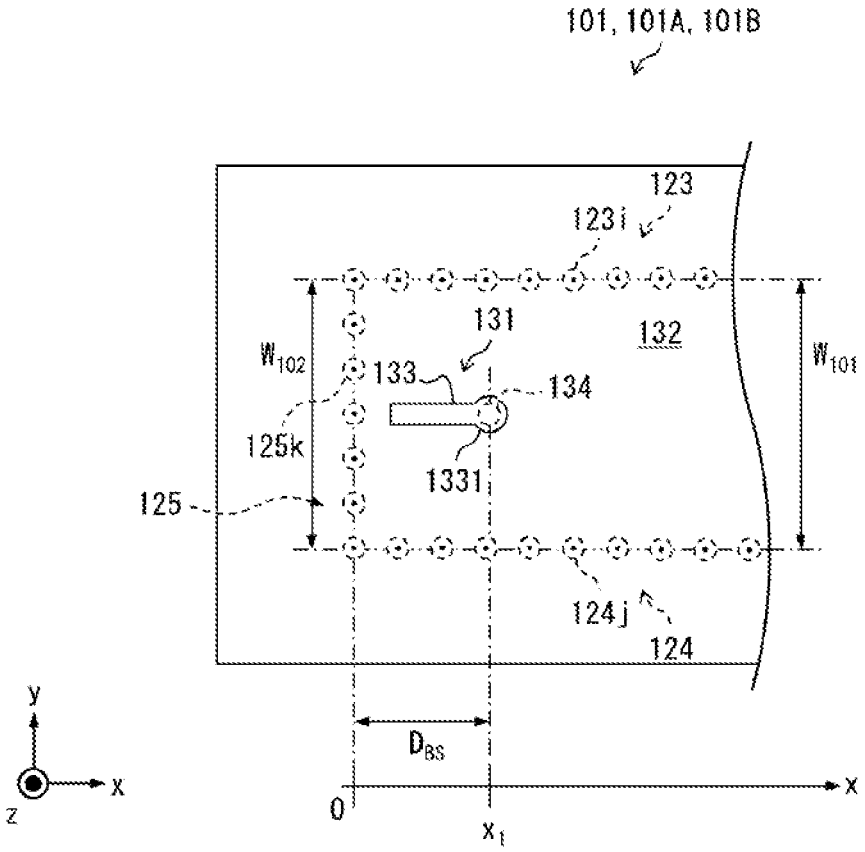
FIG. 5 is a plan view of post-wall waveguides each used as a Comparative Example of the present invention.

A configuration of each of post-wall waveguides 101, 101A, and 101B, each used as a Comparative Example compared with the post-wall waveguide 1A of Example 1 and the post-wall waveguide 1C of Example 2, will be described with reference to FIG. 5. FIG. 5 is a plan view of the post-wall waveguides 101, 101A, and 101B.

Each of the post-wall waveguides 101, 101A, and 101B was different from the post-wall waveguide 1A and the post-wall waveguide 1C only in that a width $W_{102}$ was equal to a width $W_{101}$. That is, each of the post-wall waveguides 101, 101A, and 101B employed, as the width $W_{102}$ of a short wall 125, such a width that $W_{102}$=$W_{101}$=1.32 mm. In other words, the width $W_{101}$ was uniformly 1.32 mm throughout the whole section of each of the post-wall waveguides 101, 101A, and 101B. Note that reference signs of members included in the post-wall waveguide 101 are derived by (i) putting a number "1" before reference signs of members included in the post-wall waveguide 1A and (ii) removing an alphabet "A" from the reference signs. Therefore, the configuration of each of the post-wall waveguides 101, 101A, and 101B will not be described here.

The post-wall waveguide 101 was designed so that an operation band thereof is a band of not less than 71 GHz and not more than 86 GHz, which band is included in the E band. As a distance $D_{BS}$, a distance of 584 μm was employed.

The post-wall waveguide 101A employed a distance of 634 μm as a distance $D_{BS}$, and the post-wall waveguide 101B employed a distance of 684 μm as a distance $D_{BS}$. These are changes in design parameter which changes were made in expectation of an improvement in reflection characteristic in the low band as later described.

Each of the post-wall waveguides 101A and 101B was configured similarly to the post-wall waveguide 101, except for the distance $D_{BS}$.

(Reflection Characteristic)

Figure 6:
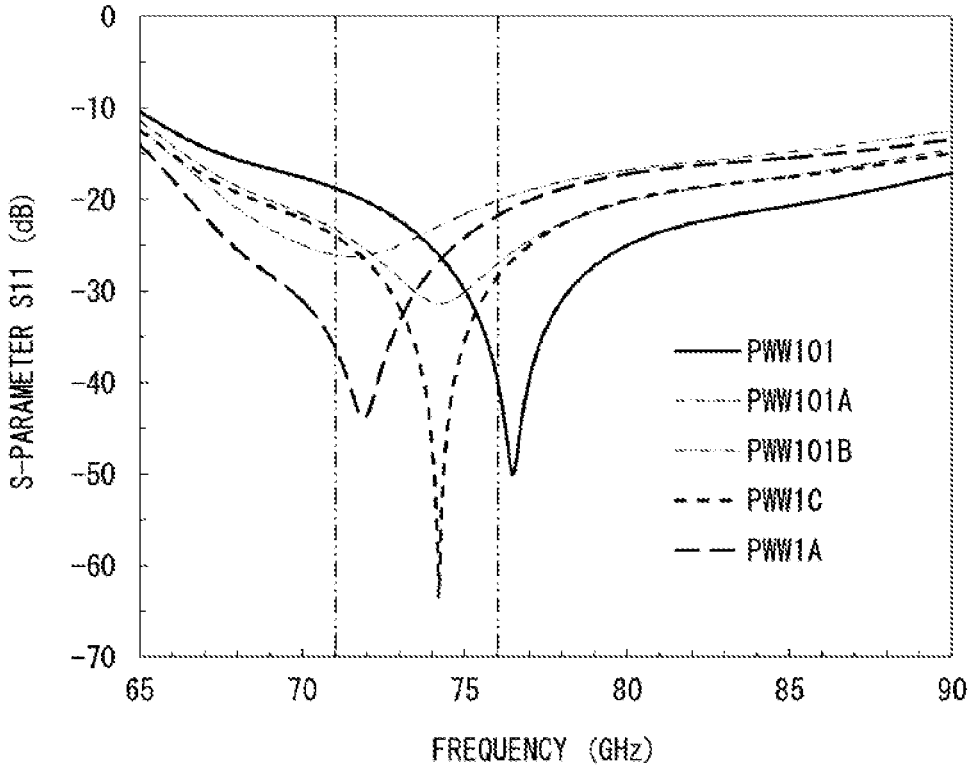
FIG. 6 is a graph showing reflection characteristics of post-wall waveguides of Examples 1 and 2 of the present invention and reflection characteristics of the post-wall waveguides of Comparative Examples.

FIG. 6 is a graph showing reflection characteristics of the post-wall waveguide 1A of Example 1, the post-wall waveguide 1C of Example 2, and the post-wall waveguides 101, 101A, and 101B of Comparative Examples. Note that chain double-dashed lines shown in FIG. 6 respectively indicate 71 GHz and 76 GHz. That is, a band sandwiched between two chain double-dashed lines is the low band.

First, the post-wall waveguide 101 is regarded as a reference. As shown in FIG. 6, the reflection characteristic of the post-wall waveguide 101 was such that a peak frequency, which is a frequency at which an S-parameter S11 is minimized, was approximately 76.5 GHz and the S-parameter S11 at a peak was approximately −50 dB.

As a frequency deviated from the peak frequency toward a low frequency side or a high frequency side, the S-parameter S11 was increased. Particularly, it was found that a degree with which the S-parameter S11 was increased was more significant in the low band and the S-parameter S11 exceeded −20 dB at a frequency of 71 GHz.

In light of the above, the post-wall waveguide 101A was prepared by increasing a value of the distance $D_{BS}$ from 584 μm to 634 μm, and the post-wall waveguide 101B was prepared by increasing a value of the distance $D_{BS}$ from 584 μm to 684 μm, in expectation of an improvement in reflection characteristic in the low band.

According to FIG. 6, a peak frequency of the post-wall waveguide 101A was approximately 74.5 GHz, and an S-parameter S11 at a peak was approximately −32 dB. A peak frequency of the post-wall waveguide 101B was approximately 71.5 GHz, and an S-parameter S11 at a peak was approximately −26 dB.

It was found from these results that the peak frequency was shifted toward the low frequency side by increasing the distance $D_{BS}$, but this caused a deterioration in reflection characteristic. Therefore, it was found that, according to the post-wall waveguide in which the width $W_{101}$ was set to 1.32 mm, which is narrower than a conventional width, so that the past-wall waveguide had a reduced size, a method of increasing the distance $D_{BS}$ was not appropriate as a method of improving the reflection characteristic in the low band.

In contrast, according to FIG. 6, a peak frequency of the post-wall waveguide 1A of Example 1 was approximately 72 GHz, and an S-parameter S11 at a peak was approximately −44 dB. Further, a peak frequency of the post-wall waveguide 1C of Example 2 was approximately 74.2 GHz, and an S-parameter S11 at a peak was approximately −63 dB.

It was found from these results that it was possible to shift the peak frequency toward a low frequency side without causing a remarkable deterioration in value of the S-parameter S11 at the peak, by configuring (i) the post-wall waveguide LA so that the width $W_{2A}$ of the short wall was greater than the width $W1_A$ of a waveguide region 12A at a location $x_{1A}$ or (ii) the post-wall waveguide 1C so that the width $W_{2C}$ of a short wall was greater than a width $W_{1C}$ of a waveguide region 12C at a location $x_{1C}$. In other words, it was found that each of the post-wall waveguide 1A and the post-wall waveguide 1C had a good reflection characteristic also in the low band (not less than 71 GHz and not more than 76 GHz), which is a band on a low frequency side of a center frequency (78.5 GHz) of a given operation band (not less than 71 GHz and not more than 86 GHz).

Note that it was found from these results that, by adjusting the width $W_{2A}$ or the width $W_{2C}$ as appropriate, it was possible to design a post-wall waveguide whose peak frequency is any frequency included in the low band and which has a good reflection characteristic.

Aspects of the present invention can also be expressed as follows:

A dielectric waveguide (1, 1A, 1B, 1C) in accordance with an embodiment of the present invention is a dielectric waveguide including: a first wide wall (21, 21A, 21B, 21C); a second wide wall (22, 22A, 22B, 22C); a first narrow wall (23, 23A, 23B, 23C); a second narrow wall (24, 24A, 24B, 24C); a short wall (25, 25A, 25B, 25C); and a mode conversion section (31, 31A, 31B, 31C), the first wide wall (21, 21A, 21B, 21C), the second wide wall (22, 22A, 22B, 22C), the first narrow wall (23, 23A, 23B, 23C), the second narrow wall (24, 24A, 24B, 24C), and the short wall (25, 25A, 25B, 25C) defining a waveguide region (12, 12A, 12B, 12C) which has a rectangular cross section or a substantially rectangular cross section and which is filled with a dielectric, the mode conversion section (31, 31A, 31B, 31C) including a columnar conductor (34, 34A, 34B, 34C) which extends from a surface of the waveguide region (12, 12A, 12B, 12C) toward an inside of the waveguide region (12, 12A, 12B, 12C) in a state where the columnar conductor (34, 34A, 34B, 34C) is apart from a contour of an opening provided in the first wide wall (21, 21A, 21B, 21C) so as to be located in a vicinity of the short wall (25, 25A, 25B, 25C), a width ($W_2$, $W_{2A}$, $W_{2B}$, $W_{2C}$) of the short wall (25, 25A, 25B, 25C) being greater than a distance ($W_1$, $W_{1A}$, $W_{1B}$, $W_{1C}$) between the first narrow wall (23, 23A, 23B, 23C) and the second narrow wall (24, 24A, 24B, 24C) at a location at which the columnar conductor (34, 34A, 34B, 34C) is provided.

According to the above configuration, it is possible to improve a reflection characteristic in a band on a low frequency side of a center frequency of a given operation band, as compared with a dielectric waveguide which is configured such that a width of a short wall is equal to a distance between a first narrow wall and a second narrow wall. Therefore, it is possible to provide a dielectric waveguide having a good reflection characteristic also in a band on a low frequency side of a center frequency of a given operation band.

The dielectric waveguide (1, 1A, 1B, 1C) in accordance with an embodiment of the present invention is preferably arranged such that the dielectric waveguide (1, 1A, 1B, 1C) has a first section ($S_1$, $S_{1A}$, $S_{1B}$, $S_{1C}$) and a second section ($S_2$, $S_{2A}$, $S_{2B}$, $S_{2C}$), the first section ($S_1$, $S_{1A}$, $S_{1B}$, $S_{1C}$) being a section in which a waveguide width, which is the distance between the first narrow wall (23, 23A, 23B, 23C) and the second narrow wall (24, 24A, 24B, 24C), is uniform, the second section ($S_2$, $S_{2A}$, $S_{2B}$, $S_{2C}$) being a section which has end parts, one of which is connected to one of end parts of the first section ($S_1$, $S_{1A}$, $S_{1B}$, $S_{1C}$) and the other of which is terminated by the short wall (25, 25A, 25B, 25C); and the waveguide width in the second section ($S_2$, $S_{2A}$, $S_{2B}$, $S_{2C}$) is made continuously greater toward the short wall (25, 25A, 25B, 25C) from a boundary between the first section ($S_1$, $S_{1A}$, $S_{1B}$, $S_{1C}$) and the second section ($S_2$, $S_{2A}$, $S_{2B}$, $S_{2C}$).

According to the above configuration, the second section does not include such a part that the waveguide width is sharply (discontinuously) varied. In other words, the second section does not include such a part that characteristic impedance is sharply (discontinuously) varied. Therefore, according to the dielectric waveguide, it is possible to suppress a return loss which can occur in a case where the waveguide width is made greater in the second section.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 1B Conductor film surrounding dielectric waveguide (a mode of a dielectric waveguide)
1A, 1C Post-wall waveguide (a mode of the dielectric waveguide)
11, 11A, 11B, 11C Substrate
12, 12A, 12B, 12C Waveguide region
21, 21A, 21B, 21C First wide wall
22, 22A, 22B, 22C Second wide wall
23, 23A, 23B, 23C First narrow wall
24, 24A, 24B, 24C Second narrow wall
23Ai, 24Aj, 25Ak, 23Ci, 24Cj, 25Ck Conductor post
25, 25A, 25B, 25C Short wall
31, 31A, 31B, 31C Mode conversion section
32, 32A, 32B, 32C Dielectric layer
33, 33A, 33B, 33C Signal line
34, 34A. 34B, 34C Columnar conductor

The invention claimed is:

1. A dielectric waveguide comprising:
a first wide wall;
a second wide wall;
a first narrow wall;
a second narrow wall;
a short wall; and
a mode conversion section,
the first wide wall, the second wide wall, the first narrow wall, the second narrow wall, and the short wall defining a waveguide region which has a rectangular cross section or a substantially rectangular cross section and which is filled with a dielectric,
the mode conversion section including a columnar conductor which extends from a surface of the waveguide region toward an inside of the waveguide region in a state where the columnar conductor is apart from a contour of an opening provided in the first wide wall so as to be located in a vicinity of the short wall,
a width of the short wall being greater than a distance between the first narrow wall and the second narrow wall at a location at which the columnar conductor is provided.

2. The dielectric waveguide as set forth in claim 1, wherein:
the dielectric waveguide has a first section and a second section, the first section being a section in which a waveguide width, which is the distance between the first narrow wall and the second narrow wall, is uniform, the second section being a section which has end parts, one of which is connected to one of end parts of the first section and the other of which is terminated by the short wall; and
the waveguide width in the second section is made continuously greater toward the short wall from a boundary between the first section and the second section.

* * * * *